United States Patent [19]

Albertson et al.

[11] Patent Number: 4,619,276

[45] Date of Patent: Oct. 28, 1986

[54] TOBACCO PROCESSING

[75] Inventors: Douglas E. Albertson, Richmond; James O. Dyson, Ashland; Eugene B. Fischer, Chester; Robert T. Gaudlitz, Richmond; Lewis A. Haws, Richmond; Gus D. Keritsis, Richmond; Louis L. Long, Richmond; Charles S. McClung, Richmond; Jose G. Nepomuceno, Richmond; Steven R. Wagoner, Richmond, all of Va.

[73] Assignee: Philip Morris Incorporated, New York, N.Y.

[21] Appl. No.: 637,259

[22] Filed: Aug. 3, 1984

[51] Int. Cl.[4] ..... A24B 15/28; A24C 15/18; A24D 1/00; A24D 1/18

[52] U.S. Cl. ..... 131/79; 131/280; 131/31; 131/62; 131/84.1; 131/309; 131/310; 131/352; 131/362; 131/364

[58] Field of Search ..... 131/84 R, 84 C, 84 A, 131/84 B, 84.1, 84.2, 84.3, 84.4, 88, 90, 94, 280, 31, 62, 79, 309, 310, 362, 364, 352

[56] References Cited

U.S. PATENT DOCUMENTS

| | | | |
|---|---|---|---|
| Re. 31,625 | 7/1984 | Kaspers et al. | 424/272 |
| 236,510 | 1/1881 | Pacholder . | |
| 973,768 | 10/1910 | Evers . | |
| 1,961,866 | 6/1934 | Rooker | 131/31 |
| 1,972,718 | 9/1934 | Sharlit | 131/31 |
| 2,067,338 | 1/1937 | Power et al. | 131/31 |
| 2,217,527 | 10/1940 | Roon | 131/12 |
| 2,617,426 | 11/1952 | Patterson | 131/66 |
| 3,012,915 | 12/1961 | Howard | 131/17 |
| 3,402,722 | 9/1968 | Kochalski | 131/84 R |
| 3,410,279 | 11/1968 | Moshy et al. | 131/140 |
| 3,611,635 | 10/1971 | Tanaka et al. | 47/58 |
| 3,834,398 | 9/1974 | Briskin et al. | 131/2 |
| 3,872,871 | 3/1975 | Fiore et al. | 131/140 P |
| 3,931,824 | 1/1976 | Miano et al. | 131/2 |
| 4,099,913 | 7/1978 | Walter et al. | 8/173 |
| 4,147,172 | 4/1979 | Calder et al. | 131/2 |
| 4,186,754 | 2/1980 | Labbe | 131/23 A |
| 4,233,993 | 11/1980 | Miano et al. | 131/2 |
| 4,341,228 | 7/1982 | Keritsis et al. | 131/354 |
| 4,409,995 | 10/1983 | Nichols | 131/84 R |
| 4,451,282 | 5/1984 | Knops et al. | 71/92 |
| 4,457,319 | 7/1984 | Lamb et al. | 131/339 |
| 4,457,774 | 7/1984 | Eue et al. | 71/93 |
| 4,457,870 | 7/1984 | Schröder et al. | 260/429 R |
| 4,457,930 | 7/1984 | Schmitt et al. | 424/248.5 |

FOREIGN PATENT DOCUMENTS

| | | |
|---|---|---|
| 1508616 | 4/1978 | United Kingdom . |
| 2119628 | 11/1983 | United Kingdom . |
| 2128873 | 5/1984 | United Kingdom . |

OTHER PUBLICATIONS

*The Condensed Chemical Dictionary*, 392–93 (G. Hawley, 9th ed., 1977).

*Primary Examiner*—V. Millin
*Attorney, Agent, or Firm*—Nelson A. Blish; Jeffrey H. Ingerman

[57] ABSTRACT

A method and apparatus are disclosed for applying foamed material to tobacco, particularly in connection with the making of cigarettes. The foamed material may be added to the tobacco, for example, in the paper guide section of a cigarette maker at the garniture mouth (21) or through the short tongue (30) or through both, or at the chimney (10). Addition of a foamed material to the tobacco, during the cigarette making process, results in a cigarette in which the material added is more uniformly distributed.

27 Claims, 12 Drawing Figures

TOBACCO PROCESSING

BACKGROUND OF THE INVENTION

This invention relates to apparatus and method for processing tobacco, and more particularly to applying a foamed material to tobacco filler in the course of cigarette manufacturing operations.

During cigarette manufacturing, various materials may be added to tobacco filler to improve certain characteristics of the finished cigarette. The material most frequently added to cigarette filler is flavoring. It is important that the material added to tobacco filler be uniformly distributed throughout the filler so that one cigarette is virtually identical to the next. It is also important that the material be added uniformly so that the individual cigarette has consistent smoking characteristics from the first puff until the last puff.

Prior attempts to achieve uniform distribution of material added to tobacco filler has involved treating the tobacco filler early in the manufacturing process prior to sending the filler to the cigarette making machine. A problem associated with adding material early in the manufacturing process is that some of the material may be lost during further processing, especially if the material added is volatile. An additional problem is that some of the material may rub off in the cigarette making machine and gum up the cigarette maker causing it to be shut down periodically for cleaning. Shutting down the cigarette maker for cleaning is obviously expensive due to both the man hours necessary for cleaning the machine and lost production time. Since many of the flavors added to cigarettes are expensive, loss of flavoring material, either due to its volatility or through build-up in the machine can also be expensive.

It is desirable, therefore, to add the material to the tobacco filler late in the manufacturing process, preferably at the cigarette making machine itself and in a uniform manner. The prior art methods of adding material at the maker have failed to achieve uniform distribution of the applied materials. For example, if material is added at the short tongue of the cigarette maker as in Nichols, U.S. Pat. No. 4,409,995, the added material may be distributed in a uniform manner per unit length along the length of cigarette rod, but some of it may be concentrated on one side of the cigarette rod rather than being distributed throughout the cross-section of the rod. If the material added is liquid, it will often result in streaking of the cigarette wrapper when added in this manner.

Often, it is necessary to add only a minute quantity of material to the tobacco filler. In the past when this has been done, either at the cigarette maker or earlier in the tobacco manufacturing process, the material is incorporated in a dilute solution added to the tobacco filler. If this is done at the cigarette making machine, as discussed for example in UK Patent Application 2,128,873A, which dicloses addition of a bonding agent in liquid form to smoking material, the excess liquid will often result in streaking of the cigarette wrapper as discussed above. If added early in the manufacturing process, the additional solution must be removed from the filler by drying which results in additional expense.

It is, therefore, an object of the present invention to provide for incorporating a selected material into cut tobacco filler so that the material is uniformly distributed throughout the tobacco.

It is also an object of the present invention to provide a method of making cigarettes wherein the material to be added to the tobacco may be introduced near the final stage of cigarette manufacturing.

Another object of the present invention is to provide a method for adding minute quantities of material to cigarette filler during the manufacturing process without the addition of excess liquid.

SUMMARY OF THE INVENTION

The present invention involves treating tobacco filler with a flavoring or other material applied in the form of a foam. By using a foamed material, the filler can be impregnated thoroughly due to the exceptional penetrating ability of foam. The low density of foam also enables application of materials in a quantity sufficient to permeate the filler without staining the cigarette wrapper. The foamed material may be added to the filler either in the chimney of a cigarette maker, before the tobacco leaves the vacuum belt, or as the tobacco drops off the vacuum belt, or at the short tongue, or at any other suitable location prior to enclosing the tobacco rod in a wrapper. The foamed material may also be applied to finished cigarettes through a hollow tube or by application to the tobacco filler prior to transporting the filler to a cigarette maker.

Figure 5:
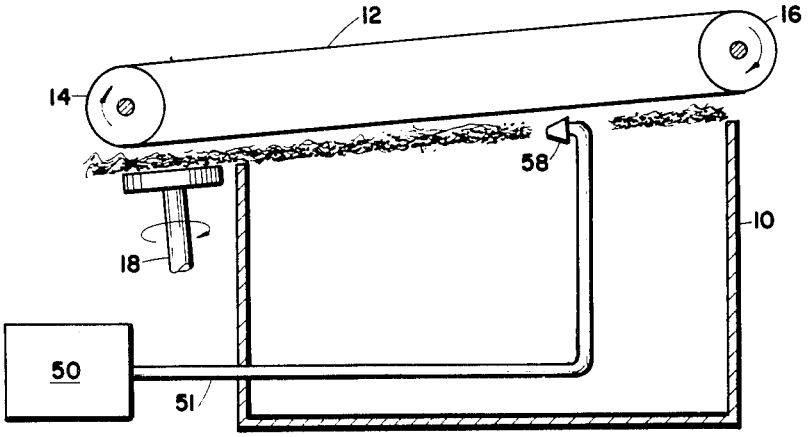
FIG. 5 is a cross-sectional view of the chimney section of a cigarette making machine according to another embodiment of the present invention.

FIG. **5*a* is a cross-sectional view of the guide block portion of the chimney looking from right to left in FIG. 5**.

Figure 6:
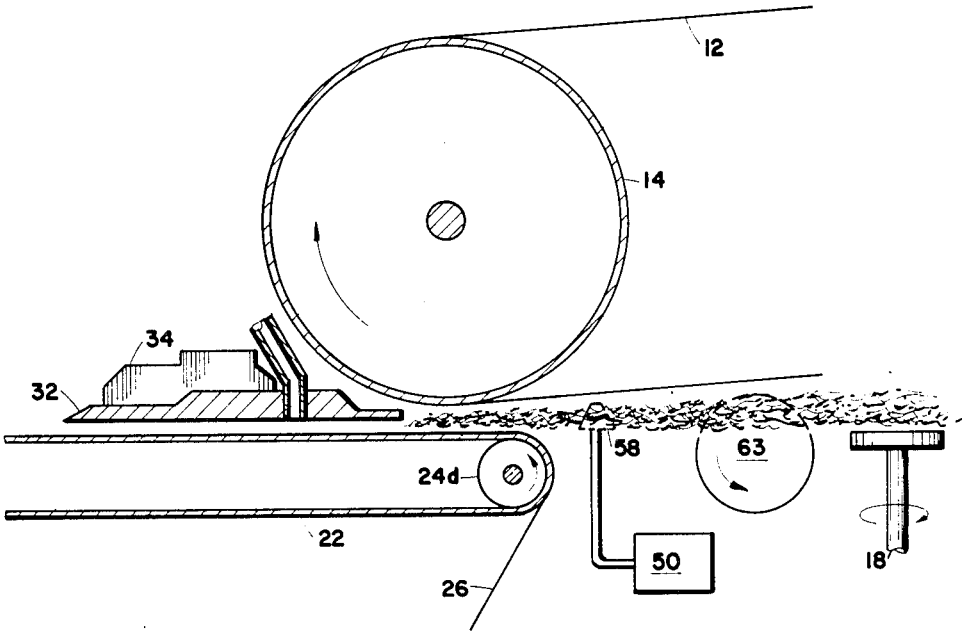

FIG. 6 is a cross-sectional view of the ecreteur section of a cigarette making machine according to yet another embodiment of the present invention.

Figure 7:
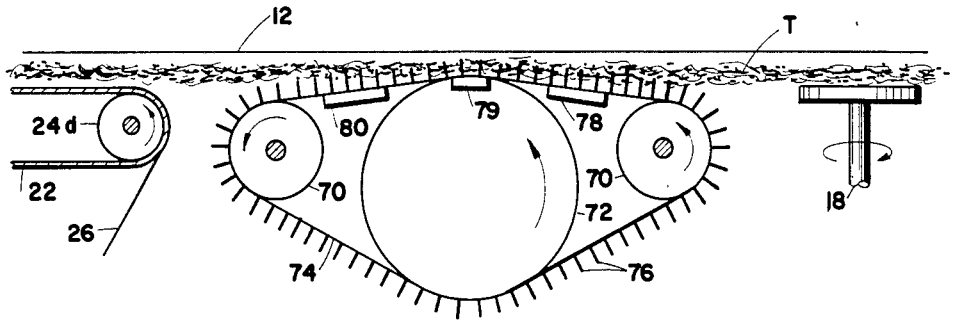

FIG. 7 is a cross-sectional view of the ecreteur section of the cigarette making machine showing a further embodiment of the present invention.

Figure 8:
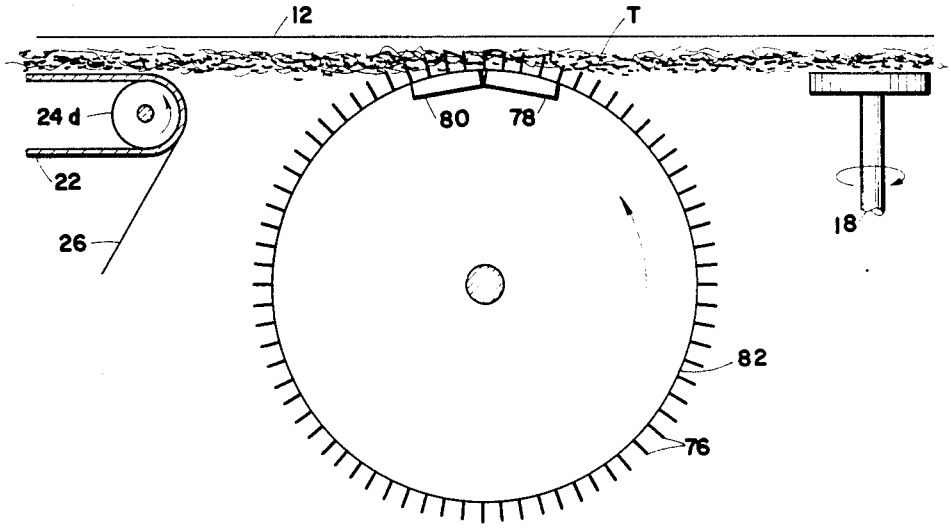

FIG. 8 is a cross-sectional view of the ecreteur section of the cigarette making machine according to an additional embodiment of the present invention.

Figure 9:
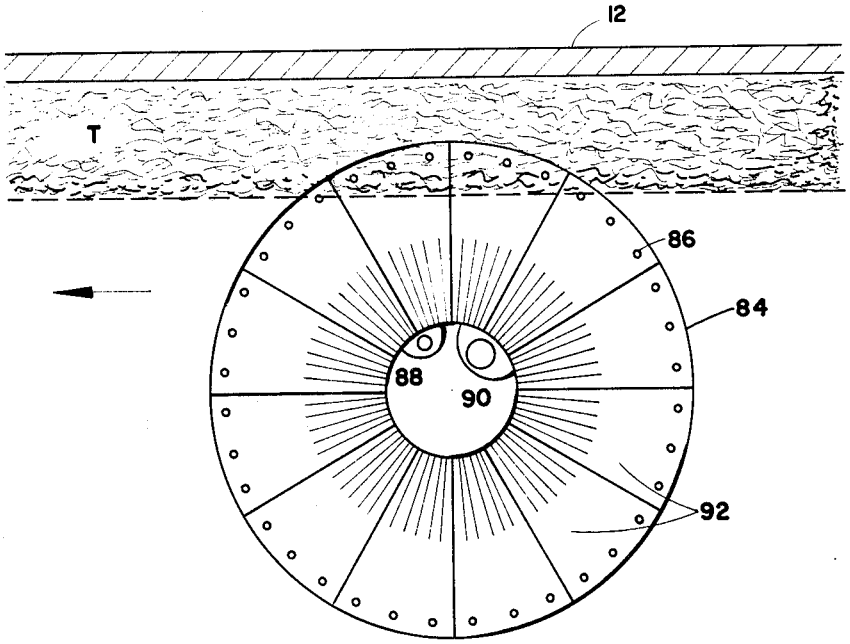

FIG. 9 is a cross-sectional view of the ecreteur section of a cigarette making machine according to an alternate embodiment of the present invention.

Figure 10:
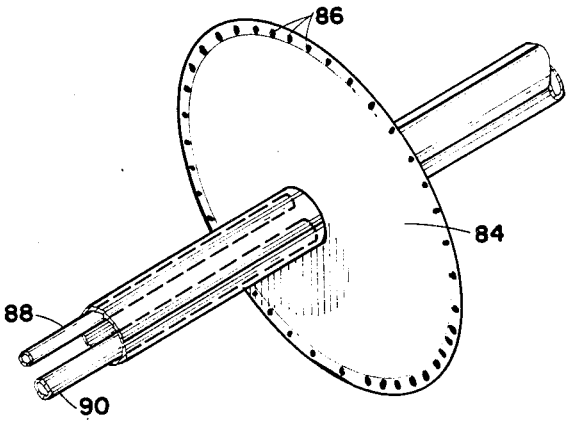

FIG. 10 is a perspective view of the cutting wheel shown in FIG. 9.

Figure 11:
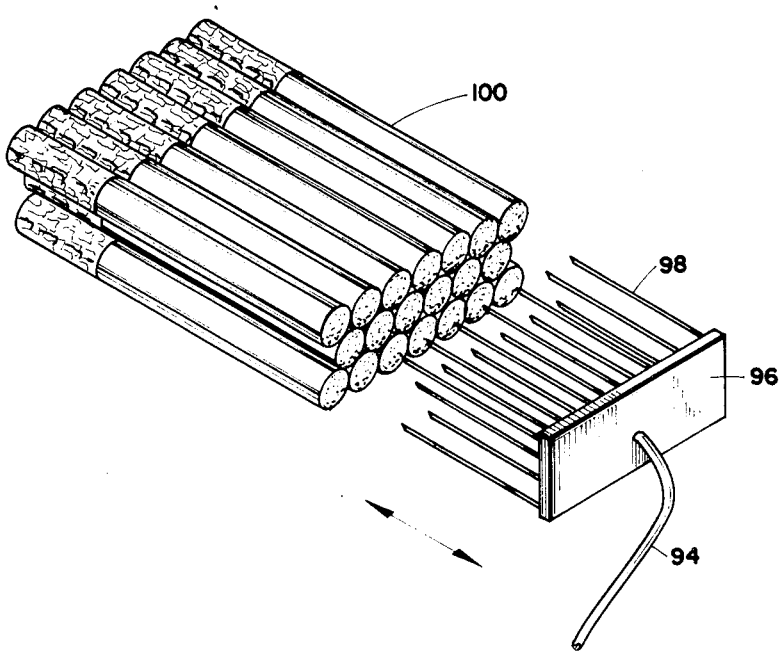

FIG. 11 is a perspective view of a further alternate embodiment of the invention for introducing foamed material prior to packing groups of cigarettes in packages.

DESCRIPTION OF THE INVENTION

The invention will now be described with reference to the drawings in which a number of representative embodiments of the present invention, some of which are particularly preferred, are disclosed. Although the foam material discussed throughout the remainder of the specification is an adhesive foam, it has been found that virtually any foamed material may be employed such as, for example, film forming or cross linking agents, binders, burn additives, casing or flavors thereby enhancing the uniformity of distribution of the material throughout the tobacco.

Although the specific cigarette making machine discussed in this specification is the Mk8 Cigarette Maker, manufactured by the Molins Company, foamed materials may be applied to tobacco filler or any suitable tobacco substitute, in virtually any cigarette making machine available commercially from a number of manufacturers. Alternatively, foamed material may be applied to any smoking article such as cigars or even non-tobacco smoking articles.

Figure 1:
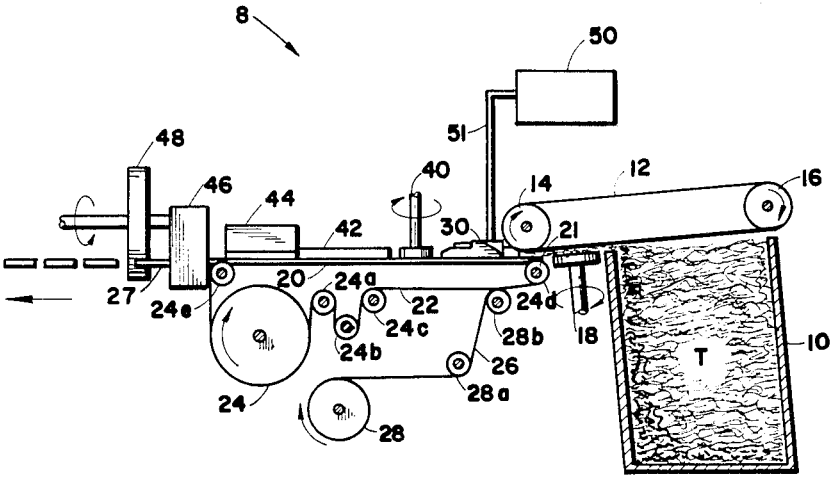
FIG. 1 is a schematic illustration of a cigaratte making machine adapted for use according to the present invention.

In FIG. 1 there is illustrated a cigarette making apparatus known as the Mk8 Cigarette Maker designated generally by reference numeral 8. Cigarette maker 8 is shown schematically to include tobacco chimney 10 from which tobacco T is blown onto a perforated vacuum belt 12 driven by rollers 14 and 16, to convey tobacco T, supported by belt 12, to ecreteur or trimmer knife assembly 18 supported for movement toward or away from the conveyed tobacco to vary the amount of tobacco on belt 12 in accordance with a cigarette weight or density based control signal.

Figure 4:
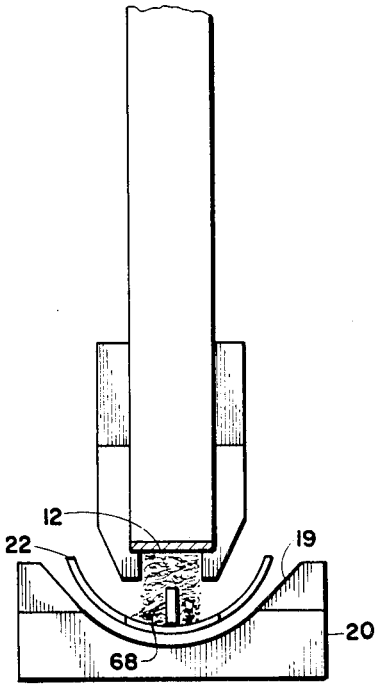
FIG. 4 is a cross-sectional view of the paper guide section shown in FIG. 3.

To the left of roller 14, cigarette maker 8 includes an elongated garniture 20 defining an open channel 19, shown in FIG. 4, extending longitudinally in a generally semi-cylindrical configuration. Endless garniture tape or belt 22 is fed to the upstream tobacco inlet mouth 21 of the garniture and transported through garniture 20 by drive wheel 24 over idler rollers 24*a*–24*e*. Cigarette paper 26 is fed to mouth 21, and to garniture tape 22, from supply bobbin 28, over idler rollers 28*a*, 28*b*, and 24*d*. Tobacco falls from belt 12 onto paper 26 as the vacuum applied to the belt is removed. On entry of garniture tape 22 into the garniture channel 19, the garniture imparts generally semi-cylindrical shape thereto, like shape being imparted to paper 26 and tobacco T deposited thereon from belt 12. Foam discharge nozzle 68, shown in FIG. 2, is located above the garniture tape 22 in the vicinity in which tobacco is being released from vacuum belt 12.

Figure 2:
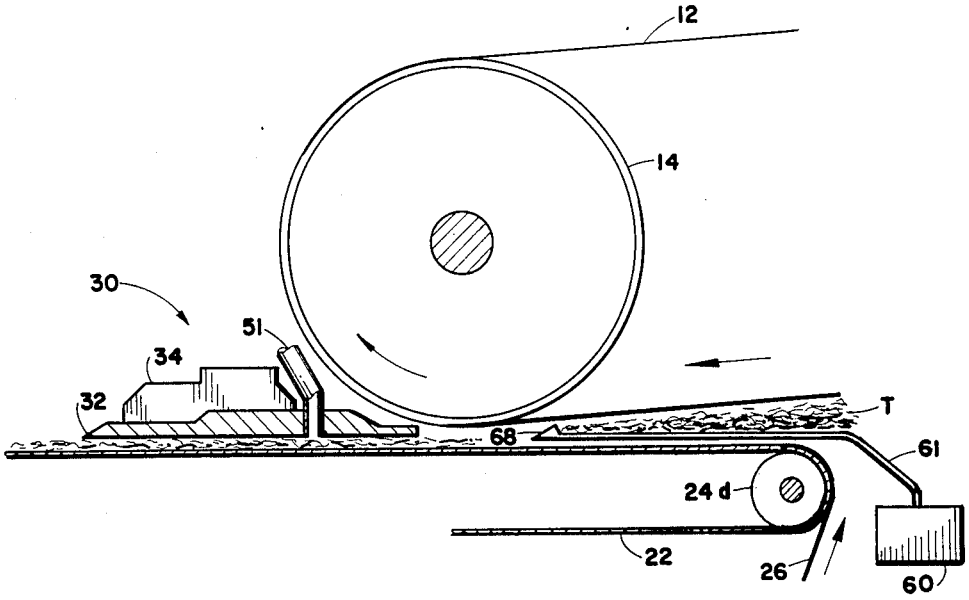
FIG. 2 is a cross-sectional view of the paper guide section and the short tongue of the cigarette making machine shown in FIG. 1.

Short tongue 30, shown in more detail in FIG. 2, has a compression foot 32 mounted on arm 34. Compression foot 32 is cooperative with garniture 20, shown in FIG. 1, to impart generally cylindrical form to the tobacco filler to form tobacco rod 27. To this end, compression foot 32 defines an open channel of generally semi-cylindrical configuration extending longitudinally, the open semi-cylindrical configuration of such channel being opposite that of the garniture and complementary thereto. Foam generator 50 supplies foamed adhesive through piping 51 through compression foot 32 to the tobacco as it is being formed into a rod.

As a formed tobacco rod 27 leaves short tongue 30, a length of cigarette paper extends tangentially from the paper wrapped rod. Paster wheel 40, shown in FIG. 1, applies an adhesive to such extending length of paper, and folder unit 42 folds such pasted length over the opposite end of the wrapper and unit 44 heat seals the rod. The sealed, continuous rod now passes through a nuclear density gage 46 and is then cut off by rod cut-off mechanism 48.

Referring now to FIG. 2, there is shown a longitudinal sectional view of the short tongue 30 and the paper guide section. Foam generator 60 supplies foamed adhesive through piping 61 to nozzle 68 which is located above garniture tape 22. Tobacco T is transported by vacuum belt 12 to a position above the garniture tape 22. As vacuum is released from belt 12, the tobacco is showered onto paper 26 which is carried on garniture tape 22. Foam from nozzle 68 is dispersed throughout the loose tobacco as it falls onto paper 26.

Referring again to FIG. 1, as the tobacco is transported through cigarette maker 8 by garniture tape 22, a general cylindrical shape is imparted to the tobacco by tape 22 in combination with garniture 20. As the tobacco passes under short tongue 30, which has a semi-cylindrical shape complimentary to the shape of the garniture 20, the tobacco is further compressed and formed into a rod. Foam generator 50 supplies additional foamed adhesive through pipe 51 into the tobacco as it passes under the compression foot 32 of short tongue 30. Adhesive foam may be applied through nozzle 68 only or through pipe 51 only and still achieve suitable dispersion within of the loose tobacco. However, applying foamed adhesive through both nozzle 68 and pipe 51 gives greater assurance that the foamed adhesive has completely penetrated the rod of tobacco.

Figure 3:
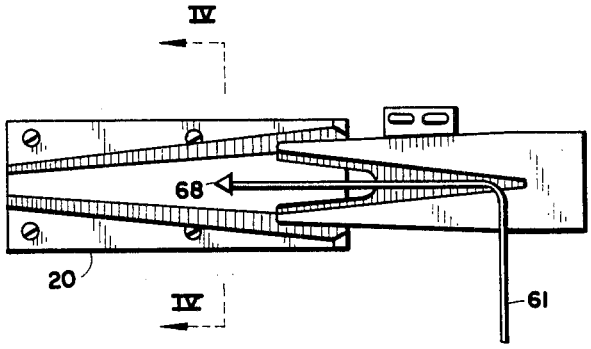
FIG. 3 is a cross-sectional view of the paper guide section, seen from above, of the cigarette making machine shown in FIG. 1.

FIG. 3 shows a longitudinal cross-section, seen from above, of the paper guide section of FIG. 2. The location of adhesive foam piping 61 and nozzle 68 with respect to the center line of garniture 20 is more clearly shown in this view.

FIG. 4 shows a cross-sectional view of nozzle 68 and garniture 20 looking from chimney 10 toward short tongue 30, taken along line IV of FIG. 3.

In general, a foamed adhesive useful in accordance with the invention will consist of a gas and a liquid adhesive. The liquid adhesive may comprise a foaming agent or a foam stabilizing agent, or a binder such as, for example, a film forming material or a cross linking agent, or combinations thereof, with or without an emulsifying agent.

Generally, the types of film-forming material which are applicable to and which may be employed in the present invention include polymers and resins selected from the classes of polysaccharides and their derivatives, synthetic thermoplastic film formers and the like, and pastes or other derivatives obtained from natural products such as tobacco, or extracts thereof, or extracellular material from cultured tobacco cells, either with or without the cells themselves.

Typical polysaccharides, polysaccharide derivatives, and synthetic film formers are disclosed in U.S. Pat. No. 4,341,228 and are incorporated by reference herein. Inorganic binders such as silicates, bentonite, etc., may also be used.

Typical foaming agents include saponines, caseinates, hydrolized proteins, soaps, sodium laurylsulfate, polyglycerol esters, and lactated esters and combinations thereof.

Adhesive foam may also be applied to the tobacco as it is drawn onto vacuum belt 12 in chimney 10 as shown in FIG. 5. As tobacco is drawn upward and accumulates on vacuum belt 12, foamed adhesive is applied from the foam generator 50 to piping 51 to nozzle 58. Although nozzle 58 may be located at various distances from vacuum belt 12, it has been found using a distance of approximately one inch from vacuum belt 12, that foamed adhesive is distributed uniformly throughout the tobacco. The distance of nozzle 58 from vacuum belt 12 will vary depending on whether the foam is injected parallel to the vacuum belt 12, as in FIG. 5, or perpendicular to the belt. When injected parallel to the belt, the nozzle may be closer.

Figure 5A:
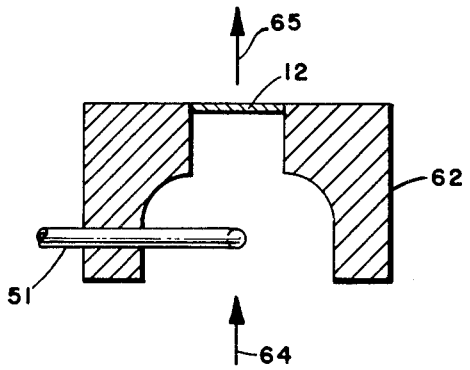

FIG. 5*a* shows a cross-sectional view of the belt guide area of the chimney 10 shown in FIG. 5 looking from right to left. Tobacco T is carried upward pneumatically in the direction indicated by arrow 64 and is deposited on a vacuum belt 12. The air stream continues upward as shown by arrow 65. Belt 12 carries tobacco in a direction into the paper. Pipe 51 carries foam through belt guide 62 to the approximate center line of vacuum belt 12. Along the center line of vacuum belt 12, pipe 51 bends downstream or into the paper, so that it is parallel to vacuum belt 12 and guide block 62. It has been found that by injecting foam in a direction parallel to the direction of motion of belt 12, tobacco builds up around nozzle 58, shown in FIG. 5, protecting the components of the chimney 10 from gumming up with foamed material.

EXAMPLE

Foamed adhesive was added to tobacco through a nozzle in the chimney section as described above. The foam was produced by a Laboratory Foam Finishing System available from Gaston County Dyeing Machine Company, Stanley, N.C. This type of foam generator produces foamed adhesive by using a beater or rotor stator to mix the gas, in this case air, and the liquid adhesive. The density of the foamed adhesive may be altered by adjusting the ratio of liquid adhesive to gas. An acceptable ratio for the density of foamed adhesive would be 0.02 gram/cc to 0.30 grams/cc. The density of the adhesive used in this test run was 0.08 grams/cc, corresponding to a liquid to air ratio of 1:12.5 by volume. The liquid adhesive used was 25 percent dextrin, 2 percent methylcellulose, 1.5 percent sodium lauryl sulfate, with the balance water. The flow rate of the adhesive depends on the speed of the maker and the application rate desired. In this example, with the speed of the cigarette maker at 2000 cigarettes per minute, the flow rate of foam with 28.5% solids was adjusted to 80 gram/minute to obtain an adhesive application of approximately 1.5 percent by weight.

The data appearing under the column headed Conventional Cigarettes is comparative data and the values are typical values for cigarettes manufactured in a conventional manner without use of foamed adhesive.

| Characteristics | 1 Conventional Cigarette | 2 Cigarette with Foamed Adhesive | 3 Cigarette with Foamed Adhesive |
|---|---|---|---|
| weight of tobacco per cigarette (g) | 0.741 | 0.744 | .708 |
| firmness* (mm 10) | 34.0 | 31.4 | 33.7 |
| coal strength (%)** | 33.0 | 23.0 | 28 |
| loose ends (g/50 cigarettes)*** | 0.68 | 0.27 | 0.31 |

*Firmness is measured by placing 15 cigarettes in 3 levels of 6, 5, and 4 in a holder having a fixed area trapezoidal shaped shoe. The filled cigarette holder is placed under a compression device in such a way so that the compression plate is properly placed to make contact with the center 40 mm section of the four cigarette rods directly in contact with the plate. The cigarettes are initially compressed with 100 g plate weight to 0.04 mm value until they stabilize in place. At this time, an additional weight of 1400 g is automatically dropped by an electromagnet. At the end of 30 seconds, the compression value is automatically recorded which is indicative of cigarette firmness.

**Coal strength is expressed as a percentage as equal to the total number of coals removed from 100 cigarettes divided by 100 cigarettes tested. The cigarettes are tested by subjecting lighted cigarettes to a three inch drop at the rate of 20 to 21 drops per minute for one minute. The cigarettes are then repuffed and the procedure repeated for another minute. Process is continued for a third time and a fourth time. At the end of the fourth testing, all cigarettes whose coals have fallen off are counted. The coal is considered to have been removed if at least two-thirds of the coal has fallen off.

***Loose ends are measured by tumbling 50 cigarettes oriented horizontally, for three minutes. The loose tobacco is collected and weighed.

Thus, it may be seen from the above data that for cigarettes of approximately the same weight, columns 1 and 2, a cigarette with adhesive foam applied has a greater firmness, greater coal strength, and less loose ends. Comparing columns 1 and 3, it is seen that a lighter cigarette with adhesive foam applied has approximately the same firmness as a conventional cigarette, with coal strength approximately the same, and loose ends significantly better.

FIG. 6 shows another method of adding foamed material to tobacco. In this method, splitter blade 63 is turning in the direction shown at a speed such that the linear velocity of the outer edge of the blade 63 is greater than or equal to the speed of tobacco conveyed on vacuum belt 12 at the point of contact. Blade 63 opens the moving stream of tobacco for foamed material to be applied inside the tobacco bed from generator 50 through pipe 51 and nozzle 58. Additional foam may be added through compression foot 32.

An alternate method of applying foamed material to the moving stream of tobacco is shown in FIG. 7. Conveyor belt 74 is moved in the direction shown so that needles 76 mounted on conveyor belt 74 penetrate the moving stream of tobacco down stream of ecreteur 18. Conveyor 74 is mounted for rotation on pulleys 70 and driven by drive wheel 72. Foamed material is supplied to the tobacco through needles 76 at reservoir 78. Additional foamed material may be applied through needles 76 at reservoir 79, thus applying foam to the moving belt of tobacco at different depths. Air reservoir 80 blows air or other gas through needles 76 in order to clear the needles of any foam. Reservoirs 78, 79 and 80 do not rotate with belt 74.

FIG. 8 shows yet another method of applying foamed material to a moving bed of tobacco down stream of ecreteur 18. In this embodiment, needles 76 are mounted on revolving nozzle 82. Foamed material is supplied to the tobacco through the needles from reservoir 78. Air reservoir 80 supplies gas to clean the nozzles. Reservoirs 78 and 80 do not rotate with nozzle 18.

FIG. 9 shows a cross-sectional view of the ecreteur section of a cigarette making machine. Cutting wheel 84, located down stream of ecreteur 18 rotates in the direction indicated at a speed such that the outer perimeter rotates faster than the linear velocity of tobacco suspended from vacuum belt 12. Foamed material is supplied to zones 92 from foam pipe 90 as cutting wheel 84 rotates. Pipe 90 and air pipe 88 are fixed in position and thus are exposed to different zones as wheel 84 rotates. The size of the zones 92 supplied by pipes 90 and 88 may vary and the relative position of the pipes may vary depending on the speed of the cutter wheel. The foamed material passes through zones 92 and leaves wheel 84 through openings 86. Air is supplied through pipe 88 to cleanse wheel 84 of excess foam. In this arrangement, the foamed material is supplied to the moving stream of tobacco along its approximate center line before the tobacco is deposited on paper 26 for forming into a rod. FIG. 10 shows cutting wheel 84 in perspective.

FIG. 11 shows a perspective view of apparatus for supplying foamed material to a finished cigarette prior to incorporating the cigarettes into a package. Foamed material is supplied through pipe 94 to header 96 and through needles 98. The needles 98 along with header 96 are moved in unison so that the needles 98 enter the group of cigarettes 100 along the approximate center lines of the cigarette. The foam is applied to the cigarettes as the needles are withdrawn from the cigarettes so that a uniform application is made along the rod of each cigarette on its approximate center line. This results in foamed material being applied near the very last stage of the manufacturing process. The method is also particularly useful when the material supplied is of a highly volatile nature, for example, menthol. Thus, the cigarettes are enclosed in an essentially air tight package immediately after insertion of the material with little change for the material to be lost due to evaporation.

The methods of applying foamed material to cigarettes, as discussed herein, show various ways foam may be applied to a moving bed of tobacco or to finished cigarettes. However, the foamed material, whether adhesive or any other material, may be applied to the finished cigarette at any point after the cigarette leaves the cigarette maker until it is inserted into a cigarette package. Additionally, the foamed material may be applied to the tobacco at any convenient point in the manufacturing process, even prior to reaching the cigarette making machine.

We claim:

1. Apparatus for manufacturing cigarettes comprising:

a cigarette maker having means to provide a moving stream of tobacco, said maker including an inlet chimney to receive cut tobacco filler, an ecreteur section, and a garniture, movable garniture tape and short tongue adapted to form said filler into a cigarette rod;

means for producing a liquid additive foam; and means for applying the liquid additive foam to said moving stream of tobacco.

2. Apparatus according to claim 1, including means for applying said liquid additive foam to the tobacco at the chimney of said maker.

3. Apparatus according to claim 2 wherein said liquid additive foam is applied to the tobacco in a belt guide section of said chimney.

4. Apparatus according to claim 3 wherein said liquid additive foam is applied to the tobacco in a direction essentially parallel to said belt guide.

5. Apparatus according to claim 1, including means for applying said liquid additive foam to the tobacco as it is being compressed by the short tongue.

6. Apparatus according to claim 1, including means for applying said liquid additive foam to the tobacco as it is being deposited on the moving garniture tape.

7. Apparatus according to claim 1, including means for applying said liquid additive foam to the tobacco between the ecreteur and the garniture.

8. Apparatus according to claims 2 or 6 or 7, including means for applying additional liquid additive foam to the tobacco as it is being compressed by the short tongue.

9. Apparatus according to claim 7, including means for applying said liquid additive foam to the tobacco through needles mounted on a conveyor belt.

10. Apparatus according to claim 7, including means for applying said liquid additive foam to the tobacco through needles mounted on a rotating nozzle.

11. Apparatus according to claim 7, including means for applying said liquid additive foam to the tobacco within an opening therein made by a splitter blade.

12. A method of manufacturing cigarettes comprising injecting foamed material into the tobacco rod of a finished cigarette through one end thereof before introducing the cigarette into its packaging.

13. In the manufacture of cigarettes, the method which comprises:

providing a moving stream of tobacco;

producing a liquid additive foam;

applying the liquid additive foam to said moving stream of tobacco.

14. A cigarette making method as in claim 13 wherein said liquid additive foam comprises a tobacco casing material.

15. A cigarette making method as in claim 13 wherein said liquid additive foam comprises a tobacco flavoring material.

16. A cigarette making method as in claim 13 wherein said liquid additive foam comprises a binder.

17. A cigarette making method as in claim 16 wherein said binder includes a film forming agent.

18. A cigarette making method as in claim 17 wherein said film forming agent comprises a polysaccharide.

19. The method of claim 17 wherein said film forming agent comprises a polysaccharide derivative.

20. The method of claim 17 wherein said film forming agent comprises a substance derived from tobacco.

21. The method of claim 20 wherein said film forming agent comprises a tobacco extract.

22. A method as in claim 13 wherein said liquid additive foam comprises a cross linking agent.

23. A cigarette making method as in claim 13 wherein said liquid additive foam is a foamed adhesive.

24. A cigarette making method as in claim 23 wherein the foamed adhesive comprises a mixture of liquid adhesive and air.

25. A cigarette making method as in claim 23 wherein the foamed adhesive comprises a mixture of liquid adhesive and a foaming agent.

26. A cigarette making method as in claim 13 wherein said liquid additive foam is applied to cut tobacco filler before it enters a cigarette maker.

27. A cigarette making method as in claim 13 wherein said liquid additive foam is applied to the tobacco as it passes through a cigarette maker.

* * * * *